US007601032B2

(12) United States Patent
Labarca et al.

(10) Patent No.: US 7,601,032 B2
(45) Date of Patent: Oct. 13, 2009

(54) APPARATUS FOR ALTERING POLES ON AN ACCESSORY

(75) Inventors: Gonzalo Labarca, Boca Raton, FL (US); Mark W. Johnson, Lauderhill, FL (US)

(73) Assignee: Motorola, Inc., Schaumburg, IL (US)

( * ) Notice: Subject to any disclaimer, the term of this patent is extended or adjusted under 35 U.S.C. 154(b) by 1056 days.

(21) Appl. No.: 11/054,529

(22) Filed: Feb. 7, 2005

(65) Prior Publication Data

US 2006/0177076 A1 Aug. 10, 2006

(51) Int. Cl.
*H01R 24/04* (2006.01)

(52) U.S. Cl. ..... 439/668; 381/124

(58) Field of Classification Search ..... 381/77, 381/124, 74; 439/1, 6, 11, 135, 138, 142, 439/147, 577, 607–610, 634, 638–640, 645, 439/668–670, 713, 725, 915

See application file for complete search history.

(56) References Cited

U.S. PATENT DOCUMENTS

| | | | | |
|---|---|---|---|---|
| 4,493,526 | A * | 1/1985 | Masuda | 439/668 |
| 4,659,167 | A * | 4/1987 | Masuda | 439/668 |
| 5,419,707 | A * | 5/1995 | Kelley | 439/21 |
| 7,241,179 | B2 * | 7/2007 | Chennakeshu | 439/668 |
| 7,295,883 | B2 * | 11/2007 | Achariyakosol et al. | 700/94 |
| 7,322,858 | B1 * | 1/2008 | Rogers et al. | 439/669 |
| 2003/0008564 | A1 * | 1/2003 | Lebron | 439/638 |

* cited by examiner

*Primary Examiner*—Xu Mei

(57) ABSTRACT

An accessory (100) has a housing (102) for varying a number of accessible poles (110A, 110C, 112A, 112C, 112E). The accessory includes a plurality of projections (110, 112) each having at least one pole coupled to an insulator (110B, 112B, 112D) to prevent electrical contact with another pole, a plurality of conduction wires (219) each insulated and connected at a first end to a corresponding pole of the plurality of projections, and at least one lever (105) coupled to a corresponding one or more of the plurality of projections for sliding one or more projections in and out of the housing in a plurality of positions (106A-C) after a force is applied on such lever, thereby controlling the exposure of a portion of at least one pole of each of one or more of the projections.

14 Claims, 2 Drawing Sheets

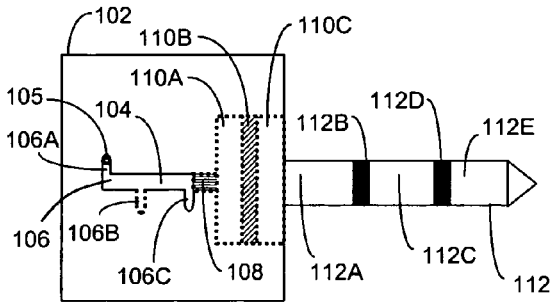
FIG. 1 100
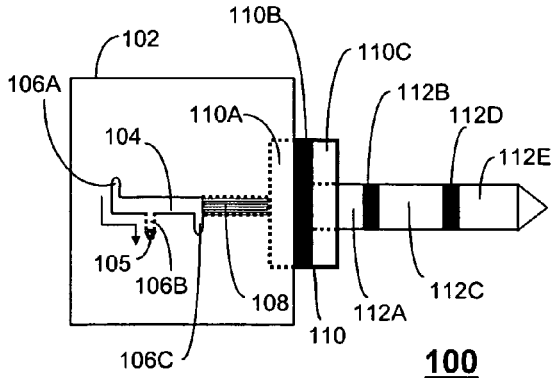
FIG. 2 100
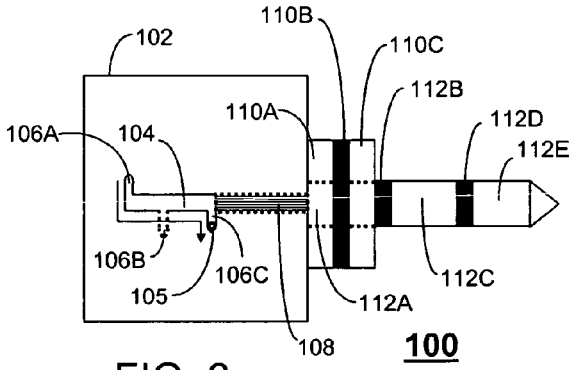
FIG. 3 100
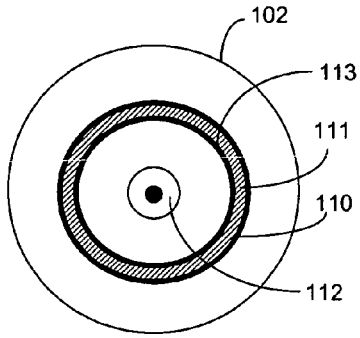
FIG. 4 100
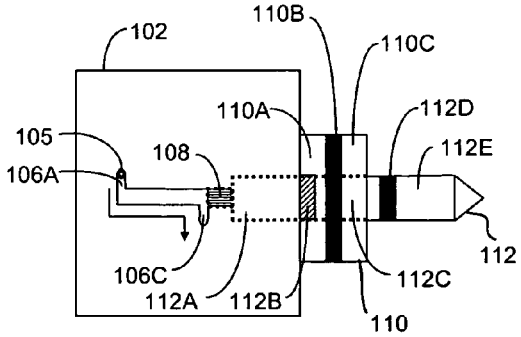
120 FIG. 5
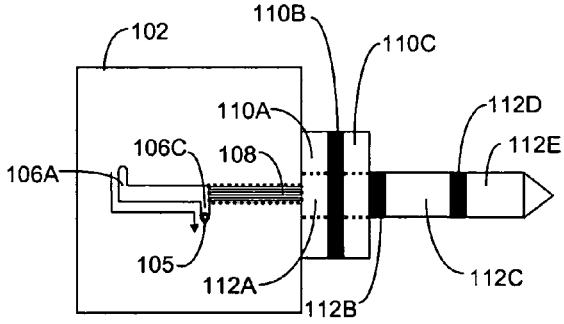
120 FIG. 6

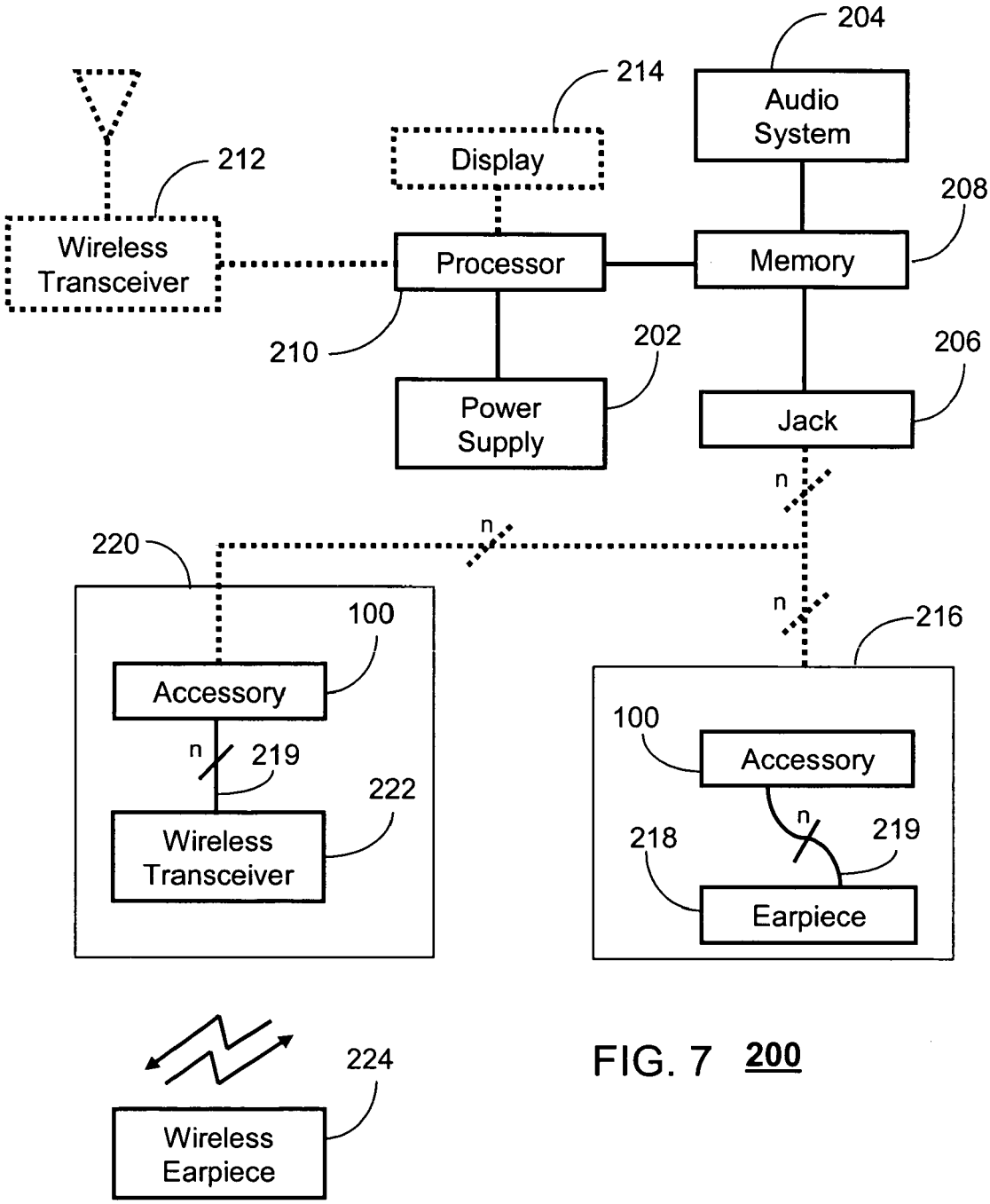
FIG. 7 200

APPARATUS FOR ALTERING POLES ON AN ACCESSORY

FIELD OF THE INVENTION

This invention relates generally to accessory devices, and more particularly to an apparatus for altering poles on an accessory.

BACKGROUND OF THE INVENTION

Manufacturers of proprietary devices often design accessories such as audio headsets, which are not compatible across manufacturers' devices. Although the functionality of the accessories might be otherwise compatible, use of incompatible jacks or plugs results in the incompatibility problem.

SUMMARY OF THE INVENTION

Embodiments in accordance with the invention provide an apparatus for altering poles on an accessory.

In a first embodiment of the present invention, an accessory has a housing that can vary the accessibility of poles. The accessory has a plurality of projections each having at least one pole coupled to an insulator to prevent electrical contact with another pole, a plurality of conduction wires each insulated and connected at a first end to a corresponding pole of the plurality of projections, and at least one lever coupled to a corresponding one or more of the plurality of projections for sliding one or more projections in and out of the housing in a plurality of positions after a force is applied on the lever, thereby controlling the exposure of a portion of at least one pole of each of the one or more projections.

In a second embodiment of the present invention, a device includes a power supply for supplying one or more power and ground signals, an audio system for processing one or more audio signals, a jack coupled to portions of the audio system and the power supply. The device can further include a memory for storing information, a processor coupled to the power supply, the audio system, and the processor for controlling operations thereof, and a headset for engaging with the jack and for conveying audible signals to a user of the device. The headset includes an earpiece having a speaker system for conveying said audible signals, and an accessory having a housing tethered to the earpiece. The accessory has a plurality of projections each having at least one pole coupled to an insulator to prevent electrical contact with another pole. The poles can be coupled to the one or more ground and audio signals when the headset is engaged with the jack. The device can further include a plurality of conduction wires each insulated and connected at a first end to poles carrying the one or more ground and audio signals and connected at a second end to the speaker system, and at least one lever coupled to a corresponding one or more of the plurality of projections for sliding one or more projections in and out of the housing in a plurality of positions after a force is applied on the lever, thereby controlling the exposure of a portion of at least one pole of each of the one or more projections and connectivity to one or more ground and audio signals of the jack.

In a third embodiment of the present invention, a wireless accessory comprises a wireless transceiver, and an accessory having a housing. The accessory includes a plurality of projections each having at least one pole coupled to an insulator to prevent electrical contact with another pole, a plurality of conduction wires each insulated and connected at a first end to said poles of the plurality of projections for carrying one or more signals supplied by a jack when said projections engage therewith, and connected at a second end to the wireless transceiver for exchanging said signals with a wireless device, and at least one lever coupled to a corresponding one or more of the plurality of projections for sliding one or more projections in and out of the housing in a plurality of positions after a force is applied on said lever, thereby controlling the exposure of a portion of the at least one pole of each of said one or more projections and connectivity to the one or more signals of said jack.

BRIEF DESCRIPTION OF THE DRAWINGS

FIGS. 1-4 are illustrations of an accessory having a housing for varying a number of accessible poles in accordance with an embodiment of the present invention;

FIGS. 5-6 are illustrations of an alternative embodiment of the accessory in accordance with the present invention; and FIG. 7 is a block diagram of a device in accordance with an embodiment of the present invention.

DETAILED DESCRIPTION

While the specification concludes with claims defining the features of embodiments of the invention that are regarded as novel, it is believed that the embodiments of the invention will be better understood from a consideration of the following description in conjunction with the figures, in which like reference numerals are carried forward.

FIGS. 1-4 illustrate perspectives of an accessory 100 in accordance with an embodiment of the present invention. The accessory 100 comprises a conventional housing structure 102 for carrying a plurality of projections 110 and 112 each having poles 110A, 110C, 112A, 112C, and 112E coupled to conventional insulators 110B, 112B and 112D, respectively, to prevent electrical contact between said poles of each projection. Projection 110 is cylindrically shaped, while projection 112 is shaped as a prong centered about projection 110. It would be appreciated by one of ordinary skill in the art that any shape could be applied to the projections 110 and 112 as well as the housing 102 without deviating from the scope and spirit of the claims described herein.

Referring to FIG. 4, a top view of projections 110-112 and the housing 102 is provided. As shown in this diagram, projection 110 can have an inner surface 113 (not seen in FIGS. 1-3) and an outer surface 110 (seen in FIGS. 1-3), which can be separated by an insulator 111. In a supplemental embodiment to the illustration of FIGS. 1-3, one or both of the inner and outer surfaces 110 and 113 of projection 110 can carry any number of poles. For example, projection 110 can have an additional two poles in the inner surface separated by a conventional insulator (similar to the outer surface), thereby raising the total number of poles of said projection 110 to four poles. Thus, any combination of poles can be applied to the inner and outer surfaces of projection 110. Accordingly, an artisan with skill in the art will appreciate that there may be less or more poles than shown in FIGS. 1-3 for each of the projections 110-112 within the spirit and scope of the claims presented below.

Referring back to FIGS. 1-3, the accessory 100 further comprises five conventional insulated conduction wires 219 (see FIG. 7) coupled to each of the poles 110A, 110C, 112A, 112C, and 112E by conventional means (e.g., stripped tip with solder applied thereto, or friction coupling) for conducting electrical signals on said poles. Additionally, the accessory 100 includes a lever 105 having a conventional shaft 108 coupled to projection 110 for sliding the projection 110 in and out of the housing 102 in any one of three positions by way of a lateral opening 106 on said housing 102 after a force is applied to the lever 105. The forcible action on the lever 105 and its corresponding shaft 108 controls the exposure of a portion of the poles 110A and 110C of projection 110. The accessory 100 in FIGS. 2-3 illustrates the exposure of poles 110A and 110C as the lever 105 (and shaft 108) is moved into positions 106B and 106C, respectively. With foregoing mechanism the accessory 100 can vary the number of accessible poles 110A and 110C of projection 110.

In a supplemental embodiment of the present invention, the accessory 100 further comprises three latches 106A-C for preventing a sliding action of said lever 105 and its corresponding projection once engaged in one of three positions. The lever 105 can rotate, slide and engage into any of the three positions shown corresponding to the latches 106A-C. The latches 106A-C shown provide the lever 105 a means to position itself outside of the lateral opening 106. An artisan skilled in the art, however, understands that there are innumerable ways to latch the lever 105 in a variety of positions. Accordingly, said alternative embodiments for the latches and any modifications and/or alterations to the descriptions of FIGS. 1-3 are understood to be within the scope of the claims described herein.

Projections 110-112 can be engaged with a device 200 (see FIG. 7) having a conventional jack 206 for mating therewith. The jack 206 can couple electrically to each of the exposed surfaces of the poles of projection 110, thereby supplying electrical signals (as will be described shortly) to pole 110A and pole 110C when the lever 105 is in position 106C (as shown in FIG. 3), pole 110C when the lever 105 is in position 106B (as shown in FIG. 2), and neither of poles 110A and 110C when lever 105 is in position 106A (as shown in FIG. 1). Since prong 112 is fixed thereby exposing its poles at all times, the jack 206 can supply signals to poles 112A, 112C and 112E once engaged with said prong 112.

FIGS. 5-6 provide an alternative embodiment of an accessory 120 similar to the accessory 100 of FIGS. 1-3 in accordance with the present invention. In this embodiment, the prong 112 is coupled to the lever 105 and its corresponding shaft 108, while the cylindrically shaped projection 110 is fixed, thereby exposing poles 110A and 110B at all times. In this embodiment, the prong 112 can slide in and out of the housing 102 according to the position of the lever 105. In this illustration, there are two corresponding latches 106A and 106C for the lever 105, which can vary the exposure of poles 112A, 112C and 112E. In position 106A, poles 112C and 112E are exposed, while pole 112A remains inaccessible inside the housing 102. In position 106C, all poles 112A, 112C and 112E of the prong 112 are exposed from the housing 102. Thus this embodiment of the accessory 100 provides variability between four and five poles when lever 105 is placed in positions 106A and 106B, respectively.

It would be obvious to an artisan with skill in the art that any number of configurations can be applied to the present invention to vary the exposure of a number of poles. For example, the lever 105 described in FIGS. 1-3 and FIGS. 5-6 can be coupled to both the prong 112 and the cylindrically shaped projection 110 thereby varying the poles on both projections 110-112 simultaneously as the lever 105 is moved in the lateral opening 106. Alternatively, separate levers can be applied to each projection 110-112 so as to vary the exposure of poles on said projections 110-112 independently.

FIG. 7 is a block diagram of a device 200 in accordance with an embodiment of the present invention. In a first embodiment, the device 200 has conventional technology comprising a power supply 202 for supplying one or more power and ground signals to the device 200, an audio system 204 for processing one or more audio signals, a jack 206 coupled to portions of the audio system 204 and the power supply 202. The device can further include a memory 208 for storing information, a processor 210 coupled to the power supply 202, the audio system 204, and the processor 210 for controlling operations thereof, and a headset 216 for engaging with the jack 206 and for conveying audible signals to a user of the device 200. In a supplemental embodiment of the present invention, the device 200 further includes a conventional wireless transceiver 212 for communicating with a conventional radio communication system, and a conventional display 214 for conveying images to a user of the device 200.

The aforementioned headset 216 comprises singly or in combination any one or more of the embodiments of the accessory 100 (or 120) described in FIGS. 1-3 and 5-6 respectively with poles that can be adjustably exposed according to the position of lever 105. The headset 216 further includes an earpiece 218 having a conventional speaker system for conveying audible signals from the audio system 204. The poles of the accessory 100 can be coupled to one end of the conduction wires 219 while the other end is coupled to the speaker system, thereby tethering the earpiece 218 to the housing 102 of the accessory 100. When the jack 206 engages with the poles of the accessory 100 one or more ground and audio signals from the power supply 202 and audio system 204, respectively, are supplied to the speaker system of the earpiece 218. By adjusting the lever 105 of said accessory 100, the exposure of said poles can be controlled so as to modify the connectivity of said ground and audio signals to the earpiece 218.

This flexibility to adjust the number of poles can be used to expand the interoperability of the headset across multiple proprietary devices. For example, a proprietary device having a jack coupled to a single audio signal and ground signal requires only a two-pole accessory. While a second proprietary device may have a jack with one ground signal, and dual (left and right) audio signals for stereo applications, thereby requiring a three-pole accessory. With the present invention, an accessory 100 can be designed according to the invention that varies the number of exposed poles in conformance with both proprietary devices.

It should also be noted that the functionality of the foregoing headset 216 can be expanded to support several other functions such as a microphone for supplying audio signals to the device (e.g., a phone or voice recording application), control buttons on the microphone for signaling the processor 210 of the start of a phone call or termination of a call, a button for performing a conventional push-to-talk application, and so on.

In yet another embodiment of the present invention, the device 200 can be coupled to a wireless accessory 220 comprising a conventional wireless transceiver 222 for communicating with another wireless device such as a wireless earpiece 224 utilizing conventional protocols such as Bluetooth™ and/or IEEE 802.11b or IEEE 802.11g. Similar to the embodiment of the headset 216, one end of the conduction wires 219 are interconnected to the poles of the accessory 100 while the other end is connected to the wireless transceiver 222. The conduction wires 219 carry one or more signals supplied by the jack 206 which are in turn exchanged with the wireless earpiece 224 over the air by way of the wireless transceiver 222.

The wireless earpiece 224 in turn can carry a conventional wireless receiver (not shown) for receive only applications, such as, for example, when listening to stereo music. Alternatively, the wireless earpiece 224 can include a microphone providing the end user of the device 200 a means for communicating audible messages back to the wireless accessory 220, which in turn provides said signals to the device 200 via the jack 206 for additional processing. It would be appreciated by one of ordinary skill in the art that there can be a number of embodiments for the wireless accessory 220 and the wireless device (embodied as a wireless earpiece 224) applicable to the claims described below.

In light of the foregoing description, it should be recognized that embodiments in the present invention could be realized in numerous configurations contemplated to be within the scope and spirit of the claims below. It should also be understood that the claims are intended to cover the structures described herein as performing the recited function and not only structural equivalents.

What is claimed is:

1. An accessory having a housing for varying a number of accessible poles, comprising:

a plurality of projections each having at least one pole coupled to an insulator to prevent electrical contact with another pole;

a plurality of conduction wires each insulated and connected at a first end to a corresponding pole of the plurality of projections; and at least one lever coupled to a corresponding one or more of the plurality of projections for sliding said one or more projections in and out of the housing in a plurality of positions after a force is applied on said lever, thereby controlling the exposure of a portion of the at least one pole of each of said one or more projections.

2. The accessory of claim 1, further comprising a plurality of latches corresponding to the at least one lever for preventing a sliding action of said lever and its corresponding projection in a select one of the plurality of positions.

3. The accessory of claim 1, wherein one of said projections is cylindrically shaped, and wherein the at least one pole of said projection corresponds to one among the inner and outer surfaces of said cylinder.

4. The accessory of claim 3, wherein another of said projections is a prong centered about the cylindrically shaped projection, wherein the prong carries said at least one pole and corresponding insulator.

5. The accessory of claim 1, wherein one of said projections is cylindrically shaped having two poles, and wherein each pole of said projection corresponds to the inner and outer surfaces of said cylinder, respectively, separated by an insulator coupled between said surfaces.

6. The accessory of claim 1, wherein one of said projections is cylindrically shaped having a plurality of poles, wherein said cylinder has a plurality of inner and outer conductive surfaces each separated by an insulator, wherein each surface corresponds to the plurality of poles, and wherein one or more of said plurality of poles are exposed from the housing in a select one of the plurality of positions controllable by a force applied to a corresponding lever of said projection.

7. The accessory of claim 1, wherein one of said projections is a prong having a plurality of poles each separated by an insulator, and wherein one or more of said plurality of poles are exposed from the housing in a select one of the plurality of positions controllable by a force applied to a corresponding lever of said projection.

8. The accessory of claim 1, further comprises a jack for receiving at least one of said plurality of projections and for interconnecting with the exposed portion of the at least one pole of said projections.

9. The accessory of claim 1, further comprising a device having a jack for engaging with the one or more poles of said plurality of projections, wherein the device conducts one or more of a group of signals on said poles comprising one or more power signals, one or more ground signals, one or more incoming audio signals, one or more outgoing audio signals, one or more display signals, one or more incoming control signals, and one or more outgoing control signals.

10. The accessory of claim 9, wherein the device comprises one or more of a group of electrical circuits comprising a power supply for supplying the one or more power signals and ground signals, an audio system for processing the one or more incoming and outgoing audio signals, a display for processing the one or more display signals, and a processor for processing the one or more incoming and outgoing control signals.

11. The accessory of claim 1, wherein a second end of the plurality of conduction wires is coupled to one or more of a group of electrical circuits comprising one or more speaker systems for conveying a corresponding one or more audible signals, one or more microphones for receiving one or more audio signals, one or more displays for displaying a corresponding one or more display signals, and one or more processors for processing one or more control signals.

12. The accessory of claim 9, wherein a second end of the plurality of conduction wires is coupled to a wireless transceiver for exchanging one or more of the group of signals with a wireless accessory.

13. The accessory of claim 12, wherein the wireless accessory comprises one or more of a group of electrical circuits comprising one or more speaker systems for conveying a corresponding one or more audible signals, one or more microphones for receiving one or more audio signals, and one or more processors for processing one or more control signals.

14. The accessory of claim 1, further comprises a lateral opening in said housing for sliding said lever, and wherein said lever is coupled to a shaft coupled to a corresponding one of said projections for sliding said projection in and out of the housing in a plurality of positions after applying a force to the lever.

* * * * *